US005097690A

United States Patent [19]

Adams

[11] Patent Number: 5,097,690

[45] Date of Patent: Mar. 24, 1992

[54] FLANGE REPAIR TOOL

[75] Inventor: James A. Adams, San Jose, Calif.

[73] Assignee: Adams & Bird, Inc., San Jose, Calif.

[21] Appl. No.: 554,713

[22] Filed: Jul. 17, 1990

[51] Int. Cl.[5] ..... B21D 3/02

[52] U.S. Cl. ..... 72/123; 72/120; 72/126

[58] Field of Search ..... 72/74, 112, 120, 121, 72/122, 125, 126, 118, 119, 123

[56] References Cited

U.S. PATENT DOCUMENTS

| | | | |
|---|---|---|---|
| 428,786 | 5/1890 | Seaman | 72/123 |
| 1,396,179 | 11/1921 | Foley | 72/125 |
| 1,524,946 | 2/1925 | Nystrom | 72/123 |
| 1,597,575 | 8/1926 | Bowman | 72/123 |
| 1,775,766 | 9/1930 | Holmes | 72/123 |
| 2,840,136 | 6/1958 | Bellarts | 72/125 |
| 3,209,571 | 10/1965 | Wilson | 72/125 |
| 4,802,355 | 2/1989 | Ezell | 72/112 |

FOREIGN PATENT DOCUMENTS

| | | | |
|---|---|---|---|
| 59-127927 | 7/1984 | Japan | 72/123 |
| 1516179 | 10/1989 | U.S.S.R. | 72/123 |

*Primary Examiner*—Robert L. Spruill
*Assistant Examiner*—D. M. Gurley
*Attorney, Agent, or Firm*—Keith Kline

[57] ABSTRACT

The present invention is a tool for repairing damaged pneumatic lines. The tool is small and compact, and is capable of being moved to the line to be repaired. The device has multiple rollers which may be adjusted to various line interior diameters and to various angles desired for the flange. When the tool is rotated, the rollers reform the flange in the subject line.

3 Claims, 5 Drawing Sheets

FLANGE REPAIR TOOL

FIELD OF THE INVENTION

The present invention relates generally to the field of machining tools, and more specifically is a portable tool for repairing flanges in the ends of thin walled tubes.

BACKGROUND OF THE INVENTION

Flanges in the ends of pipes or tubing have been used as a means of connection for a great many years. The prior art has several examples of equipment that was invented to aid in the creation of these flanges.

The "Flanging Device" of R. M. Bowman, U.S. Pat. No. 1,597,575, is an early example. This device was designed to enable the flanging of fire boxes for upright boilers. Another example of the early art is the "Cutting and Flanging Tool" of J. Zang U.S. Pat. No. 1,830,865.

Another related area of prior art is found in the can industry. Devices such as the "Can Straightener" of J. L. Rickhoff, et al., U.S. Pat. No. 2,612,204, and the "Spin-Flanger for Beverage Containers" of C. Ross Nichols, et al., U.S. Pat. No. 4,435,969, are examples of this art.

In the airline industry, as in many other businesses, one of the common items of maintenance is the need to repair flanges in pneumatic lines. Currently, this requires removal of the damaged line, transport of the line to the appropriate machine, and then replacement of the repaired line in the plane or other machine.

This mode of operation represents the chief disadvantage of the devices in the prior art, that is, that they are fixed in place. They are too bulky and cumbersome to be easily transported. If it were possible to repair the flange while the line is in place, it would save a great deal of time, and hence, money.

SUMMARY OF THE INVENTION

Accordingly, it is an object of the present invention to provide a device that enables the user to repair a flange in a metallic line (tube or pipe), such as pneumatic lines, without first removing the line from its machine.

The present invention is a hand held device, the portable flange repair tool.

The flange repair tool consists of a central shaft which supports a flanging mechanism. The flanging mechanism includes diameter adjustment means to allow the tool to be adjusted to operate on lines of various diameters.

The tool further includes means to adjust the angle of multiple flanging rollers, which are the elements that contact the line and reform the flange.

In operation, the tool is introduced into the subject line. The tool is then expanded so that the flanging wheels contact the inner diameter of the line. A jam nut is used to fix the tool at the proper diameter. If necessary, the angle of the rollers can then be adjusted via a second jam nut according to the angle requirement of the particular flange.

The tool is then rotated so that the rollers pass along the entire inner circumference of the line, deforming the metal to the desired flange angle. Generally, a socket or wrench is used to apply torque to a hexagonal end portion of the central shaft, causing the tool to rotate.

The objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
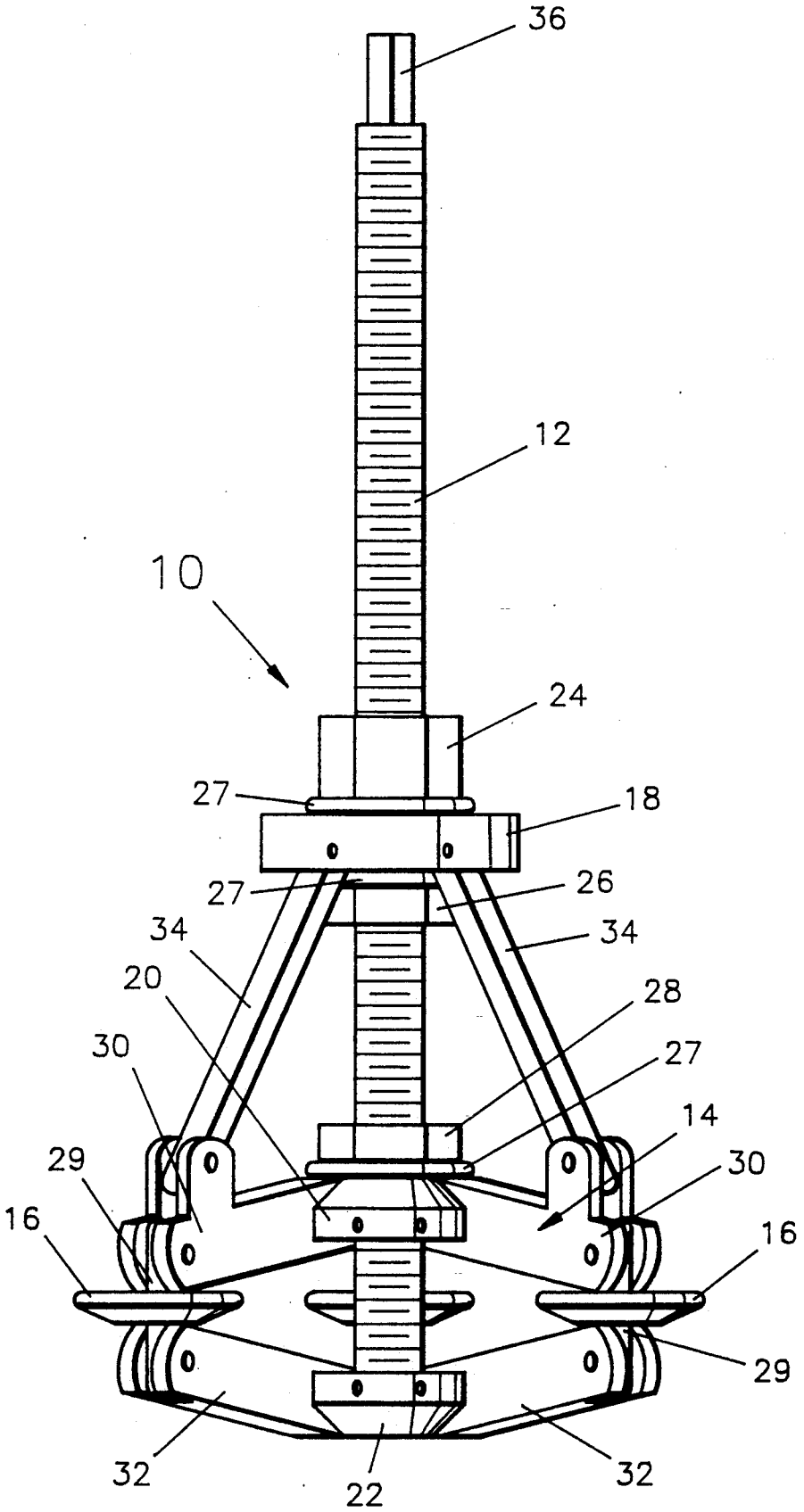
FIG. 1 is a front view of the present invention.
Figure 2:
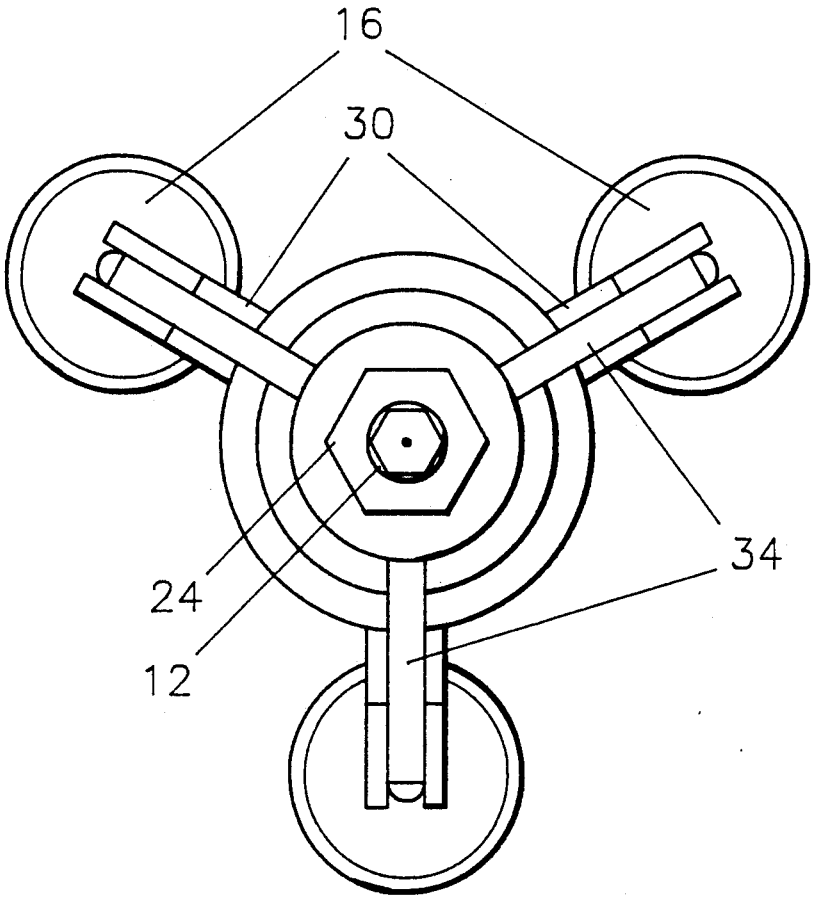
FIG. 2 is a top view of the present invention.

The present invention is a hand held flanging tool 10, as depicted in FIG. 1. The tool 10 includes a threaded central shaft 12 which supports a flanging mechanism 14.

The mechanism 14 has three elements which control its position along the threaded central shaft 12: a first adjustable collar 18, a second adjustable collar 20, and a fixed base collar 22.

A first jam nut 24 in conjunction with a locking nut 26 controls the position of the first adjustable collar 18 along the central shaft 12. The position of the first collar 18 determines the effective diameter of the rollers 16.

A second jam nut 28 is used to control the position of the second adjustable collar 20 along the central shaft. The position of the second adjustable collar 20 determines the angle of contact of multiple rollers 16. (A detailed description of the operation and adjustment of the tool 10 follows below, after this description of the construction of the elements of the tool 10.)

Washers 27 may be inserted between the nuts 24, 26 & 28 and the collars 18 & 20.

Figure 3:
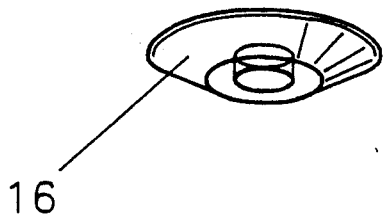
FIG. 3 is a perspective view of a roller.

The rollers 16 accomplish the deformation of the flange material of a subject pipe or tube. In a preferred embodiment, there are three rollers 16 spaced at 120° intervals about the central shaft 12. The rollers 16 are solid circular tapered disks with an aperture in their centers. (See FIG. 3.)

The edge of the rollers 16 that has the larger circumference is tapered to fit into the flange and to maximize the area of surface contact. This reduces the chances of the material of the subject line being torn when the flange is repaired.

The rollers 16 turn freely about roller axles 29. The axles 29 are pivotally attached at one end to a first set of support bars 30. The roller axles 29 are pivotally attached at their other end to a second set of support bars 32.

The first support bars 30 are pivotally attached to the second collar 20 at their end not attached to the axles 29. The second support bars 32 are pivotally attached to the base 22 at their end not attached to the axles 29.

A set of adjustment arms 34 are pivotally attached at one end to the first collar 18 and are pivotally attached at their other end to the midpoint of the first support bars 30.

It should be noted that the pivotal attachments of the above described elements allow pivoting in one plane only, which must be a plane parallel to that of the longitudinal axis of the central shaft 12. That is, the circumferential spacing of the rollers 16 and their support elements does not change.

Figure 6:
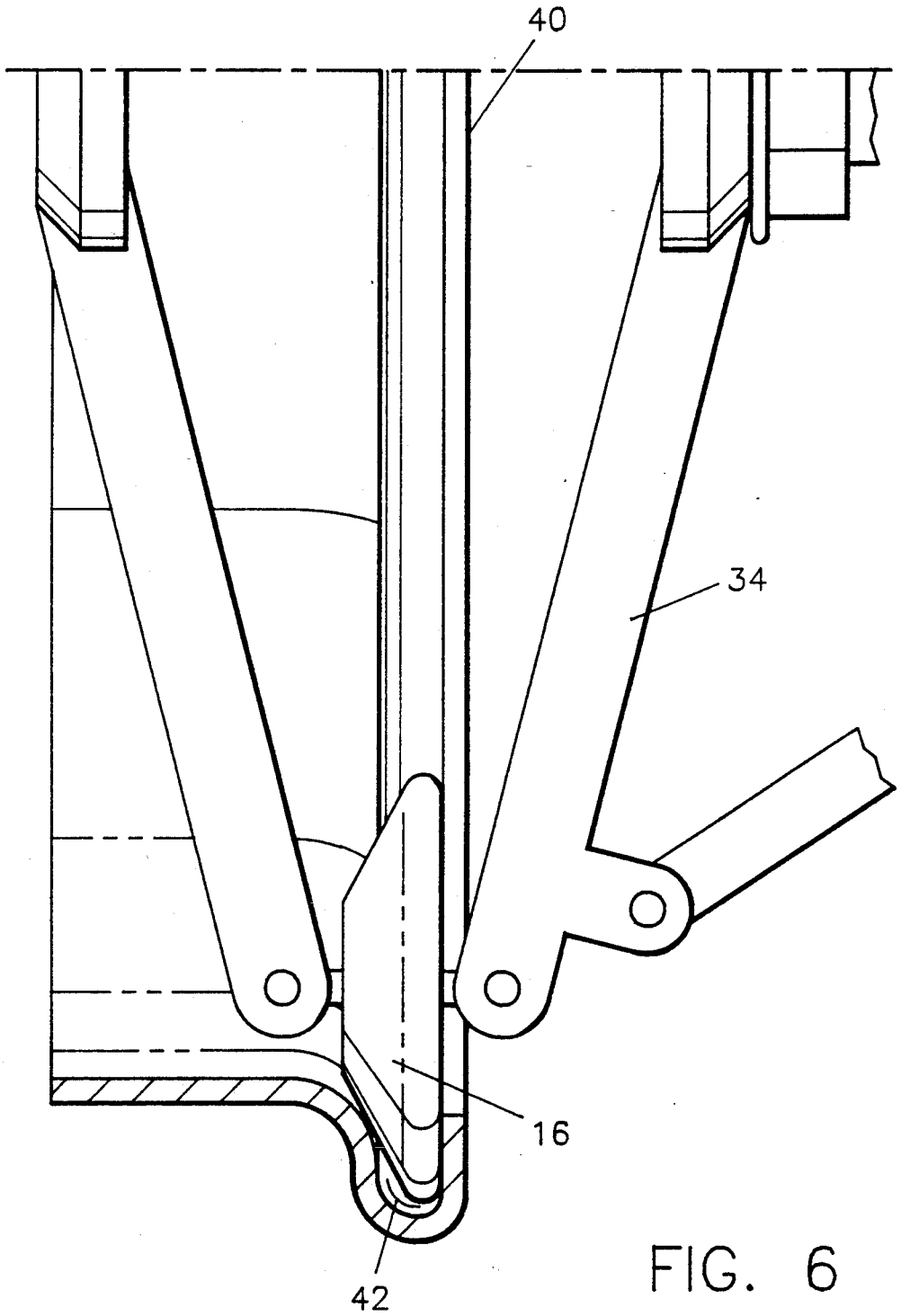
FIG. 6 shows the flange repair tool in position in a pneumatic line flange.

In use, the operation of the flanging tool 10 is as follows: (see FIG. 6)

Figure 4A:
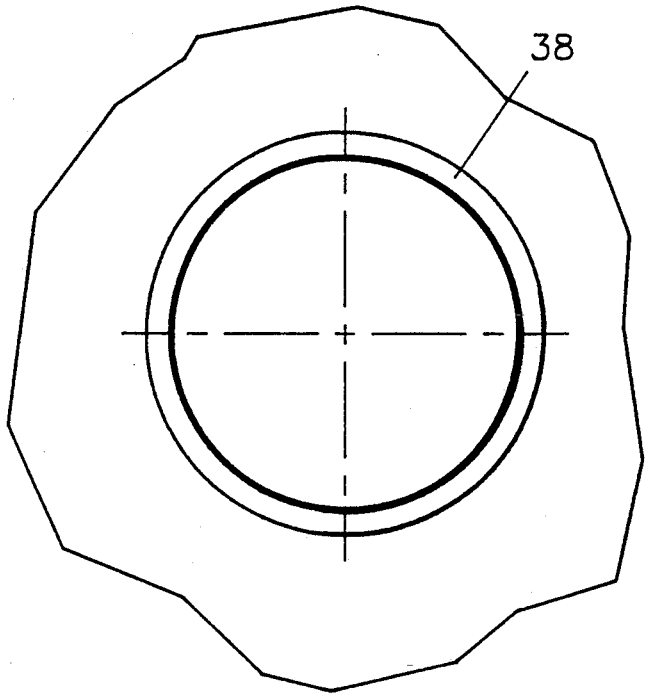
FIG. 4A is a top view of a "lightening hole" flange.
Figure 4B:
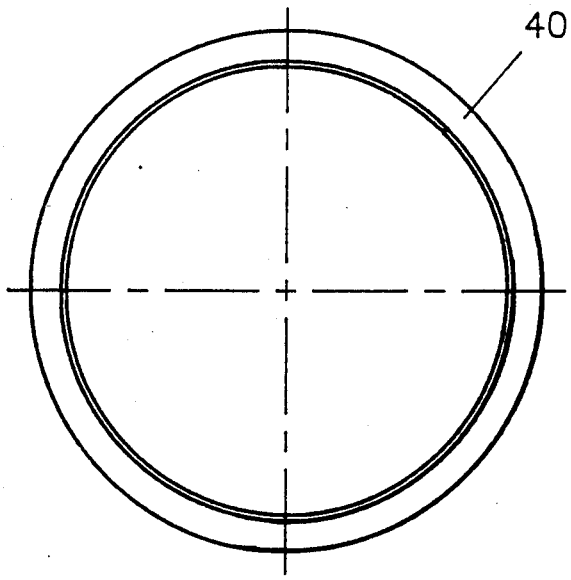
FIG. 4B is a top view of a pneumatic line flange.
Figure 5A:
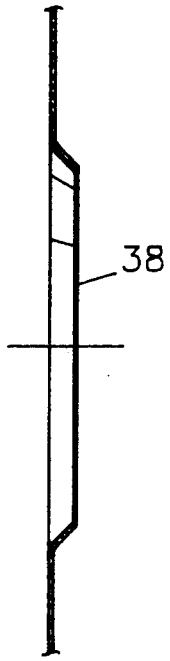
FIG. 5A is a cross section of a "lightening hole" flange.
Figure 5B:
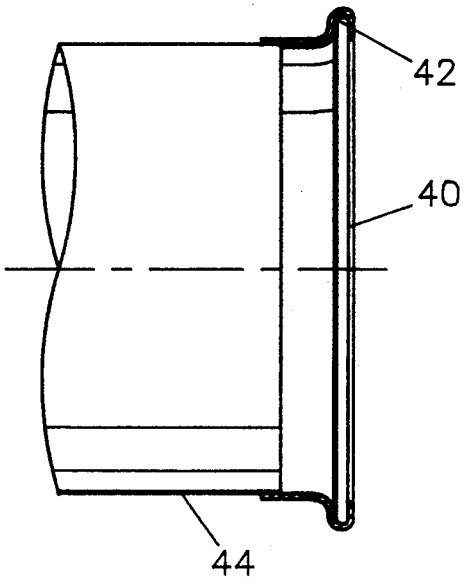
FIG. 5B is a cross section of a pneumatic line flange.

The function of the tool 10 is best understood with reference to the difference between a pneumatic line flange 40 (see FIGS. 4B & 5B) and a common "lightening hole" 38 flange (see FIGS. 4A & 5A). The function of the lightening hole flange 38 is to merely provide a surface which is smoothed enough so as to not sever electrical and other lines passing through the hole. There is no need for precision machining for the lightening hole 38.

Figure 5C:
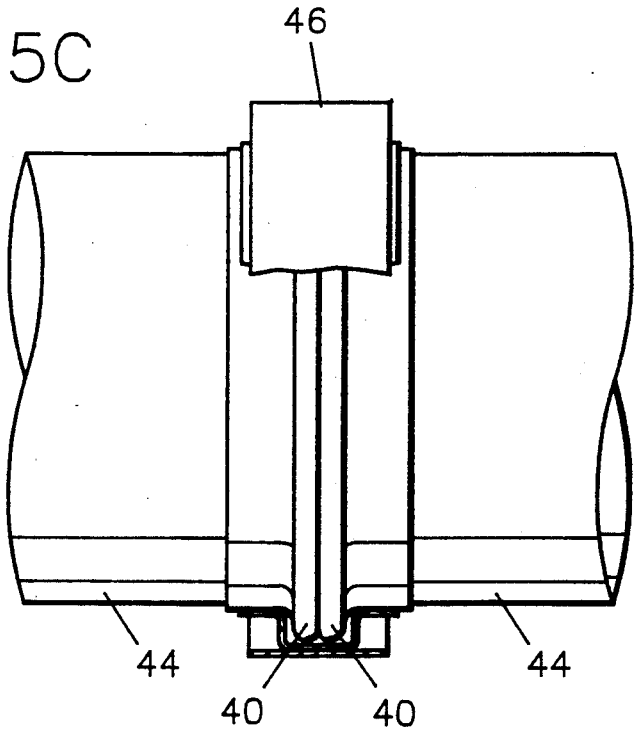
FIG. 5C is a partial cross section of a pneumatic line joint.

Referring to FIG. 5C, the need for the pneumatic line flange 40 to have a nearly vertical face can be seen. The aircraft industry requires flanges of either 5° or 7°. A precision flange face is required because the flanges 40 are used to create joints in the high pressure pneumatic lines 44. The two flanged ends of the pneumatic lines 44 are placed in physical contact, then secured with a clamp 46. During use, an inner flange cavity 42 may become crushed or otherwise distorted. The inner flange cavity 42 and the flange face 40 may be restored to their proper conformation by the flange repair tool 10. Expansion of the effective diameter of the rollers 16 is accomplished by moving the locking nut 26 toward the base 22. The first adjustable collar 18 can then be slid along the central shaft 12 toward the base 22, the inner diameter of the collar 18 not being threaded. If greater force is required, it can be applied by rotating the locking nut 24 against the collar 18.

The movement of the collar 18 cause the adjustment arms 34 to apply force to the support arms 30 & 32, which in turn urges the rollers 16 away from the central shaft 12, and thereby increases the effective diameter of the device.

When the rollers 16 have reached the desired diameter, if the jam nut 24 has not been used to apply force, it must be moved toward the base 22 until it contacts the first collar 18. This inhibits the first collar 18 from being pushed back along the central shaft 12.

The locking nut 26 is then moved away from the base 22 until it also contacts the first adjustable collar 18, thus locking the first adjustable collar 18 in place. This secures the mechanism 14 so that the effective diameter of the rollers 16 cannot change while the tool is in operation.

If the contact angle (with the surface of the line) of the rollers 16 needs to be changed, the second jam nut 28 can be screwed against the second adjustable collar 20, so that it moves toward the base 22. This causes the support bars 30 & 32 to approach a position normal to the central shaft 12.

This movement changes the distance from the central shaft 12 to the attachment point of the axles 29 in the first support arms 30. Since the distance from the central shaft 12 of the attachment points of the axles 29 in the second support arms 32 is unchanged, the angle of the axles 29 relative to the central shaft 12 is changed, thus altering the contact angle of the rollers 29. (Normally, the aircraft industry requires flanges of either 5° or 7°.)

Once the proper diameter and angle of the wheels 16 has been achieved, the tool 10 is rotated by applying torque to the central shaft 12. This is accomplished by using a wrench or socket applied at a hexagonal segment 36. The hexagonal segment is formed by affixing a wide nut to the end of the threaded stock of the central shaft 12.

The tool 10 is rotated until the rollers 16 have circumscribed the inner flange cavity 42 of the flange 40 being repaired. After the rotation of the tool 10, the flange 40 will be restored to its original desired conformation. Repeated diameter adjustments and rotations may be required for severely damaged flanges.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A device to repair flanges in thin walled tubes (lines) comprising:

a central threaded shaft; and a flanging mechanism including multiple rigid rollers;

wherein torque applied to the central shaft causes the flanging mechanism to rotate, thus causing the rollers to circumscribe an inner flange cavity that has been distorted, the circumscription reforming the inner flange cavity, and thus a flange face, to their proper orientation so that a seal with a second flange may be formed;

and wherein the flanging mechanism has means for adjusting the effective diameter of the rollers, the adjustment of the effective diameter being accomplished by changing the position of a first adjustable collar along the threaded central shaft, the first adjustable collar being pivotally attached to adjustment arms, which adjustment arms are in turn pivotally attached near the midpoint of a first set of support bars, the first set of support bars being pivotally attached to axles supporting the rollers;

and wherein the flanging mechanism has means for adjusting the contact angle of the rollers, the adjustment of the contact angle being accomplished by changing the position of a second adjustable collar along the threaded central shaft, the second adjustable collar being pivotally attached to one end of the first set of support bars, and the other end of the support bars is pivotally attached to one end of the axles supporting the rollers, and the other end of the axles is pivotally attached to one end of a second set of support bars, the other end of the second set of support bars being pivotally attached to a fixed base collar.

2. The device of claim 1 wherein:

the device is small enough so as to be hand held and portable.

3. The device of claim 1 wherein:

the end of the shaft opposite the flanging mechanism has a hexagonal segment to allow torque to be applied by means of a socket or wrench.

* * * * *